US009839316B2

(12) United States Patent
Brinegar

(10) Patent No.: US 9,839,316 B2
(45) Date of Patent: Dec. 12, 2017

(54) ORNAMENT

(71) Applicant: Joey Brinegar, Baton Rouge, LA (US)

(72) Inventor: Joey Brinegar, Baton Rouge, LA (US)

( * ) Notice: Subject to any disclaimer, the term of this patent is extended or adjusted under 35 U.S.C. 154(b) by 0 days.

(21) Appl. No.: 15/061,143

(22) Filed: Mar. 4, 2016

(65) Prior Publication Data

US 2016/0255979 A1 Sep. 8, 2016

Related U.S. Application Data

(60) Provisional application No. 62/129,227, filed on Mar. 6, 2015.

(51) Int. Cl.
*A47G 33/08* (2006.01)

(52) U.S. Cl.
CPC ..... *A47G 33/08* (2013.01)

(58) Field of Classification Search
CPC ..... A47G 33/08; A47G 33/0809
See application file for complete search history.

(56) References Cited

U.S. PATENT DOCUMENTS 2,784,512 A * 3/1957 Goodwin ..... A47G 33/08 220/4.21
3,757,442 A * 9/1973 Cook ..... A47G 33/08 24/357
4,173,667 A * 11/1979 Rusch ..... A47G 33/08 206/575
4,224,364 A * 9/1980 Hunt ..... A47G 33/08 40/617
4,889,748 A * 12/1989 Dudley ..... A47G 1/06 40/661
5,116,648 A * 5/1992 Martin ..... A47G 33/08 206/232
5,273,794 A * 12/1993 Engel ..... A47G 1/14 428/11
6,022,437 A * 2/2000 White ..... A47G 33/08 156/212
6,399,167 B1 * 6/2002 Lewis, Jr. ..... A47G 33/08 428/11

* cited by examiner

*Primary Examiner* — Gary C Hoge
(74) *Attorney, Agent, or Firm* — John B. Edel; Edel Patents LLC

(57) ABSTRACT

Ornaments are disclosed that include an ornament body, paper within the ornament body and a support for holding a portion of the paper. The support and paper may be configured such that portions of the paper transition through a display position with certain versions of the ornament having the paper configured as a scroll. The ornament may also have a size and configuration allowing it to be hung from a tree such as a Christmas tree.

8 Claims, 10 Drawing Sheets

ORNAMENT

This application claims the benefit of provisional application No. 62/129,227 filed on Mar. 6, 2015 and entitled "Ornament."

Embodiments of ornaments described herein may be capable of opening and closing, storing items inside the ornament and may contain a scroll or other paper inside the ornament for recording information. Certain features regarding the ability to record notes in the ornament have particular utility associated with New Year's resolutions such as the recording of New Year's resolutions in the ornament which may be stored and reviewed on a year-to-year basis.

The scroll inside certain embodiments may be attached to a mechanism that lets a user scroll forward to review past entries and to record new entries. Such review and recording may occur on a year to year basis. There may be four notches in the support pieces that extend under a flat platform inside the ornament. This allows the two long rods to be inserted into place. On one end of each rod is a flat round piece to secure it in place within the support pieces beneath the platform. On the other end of each rod a knob piece may be positioned to allow the paper to scroll across the platform while the scrolls rotate in place within the support pieces when those knobs are turned by a user. There is a slit in each rod for the paper scroll to be inserted and attached. The roll of paper may attach to one rod and may cross over the flat platform returning to the other side of the platform and attaching to the second rod. This enables the platform to be used for writing the resolutions. The scrolls with knobs allow the paper to be moved forward as the paper is inscribed upon. The whole platform may be removed as one piece with the rods and paper attached in place. When a user is ready to begin writing resolutions for the next year, he or she may take the platform piece out by simply lifting it out and turning the scroll forward by turning one of the knobs attached to the rods.

The flat platform with knobs attached below allows the paper to roll over the platform. The scroll configuration also allows for small items to be placed inside as a unique way to present a gift on top of the scroll paper. The platform sits on a lip that acts as a ledge for the platform so that it may remain level. The paper scrolled over the platform or items sitting on the platform have a level surface that allows items to be showcased when the top of the ornament is removed.

The twist off top of the ornament is designed with a self-locking notch. This enables the ornament to be tightly secured when closed. If the ornament is used to hold a small item of reasonable weight the ornament will not separate or come undone when hanging on a Christmas tree.

DETAILED DESCRIPTION

Example 1

Figure 1:
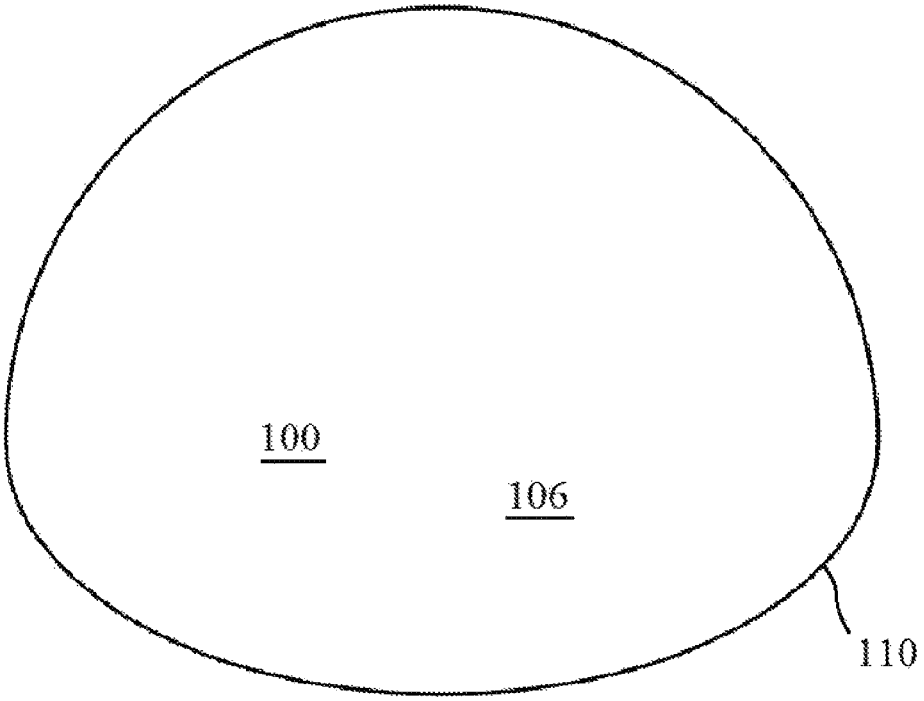
FIG. 1 depicts a perspective view the underside of an ornament bottom piece.
Figure 2:
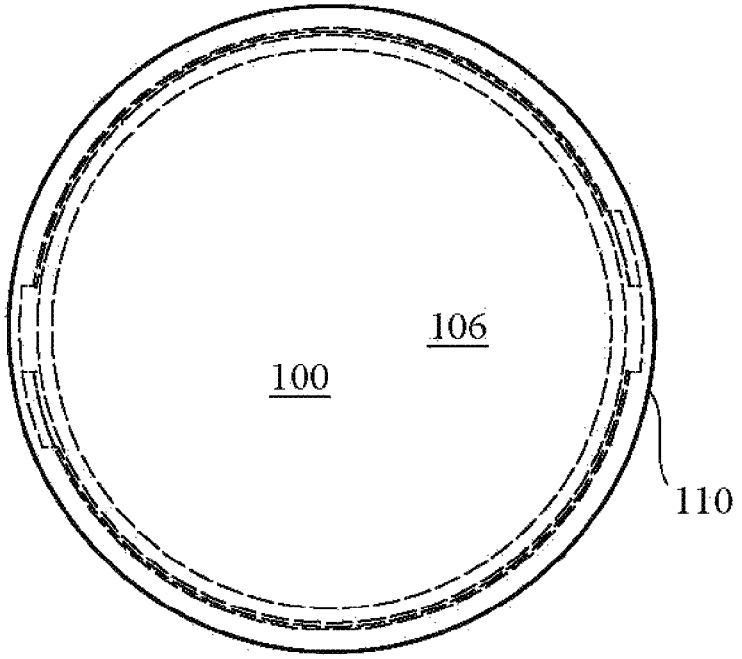
FIG. 2 depicts an outside plan view of the ornament bottom piece.
Figure 3:
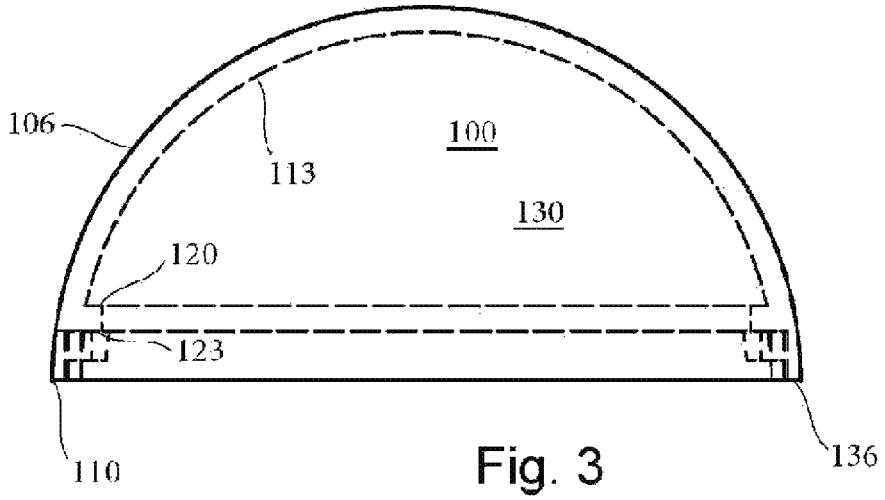
FIG. 3 depicts an elevation view of the ornament bottom piece.
Figure 4:
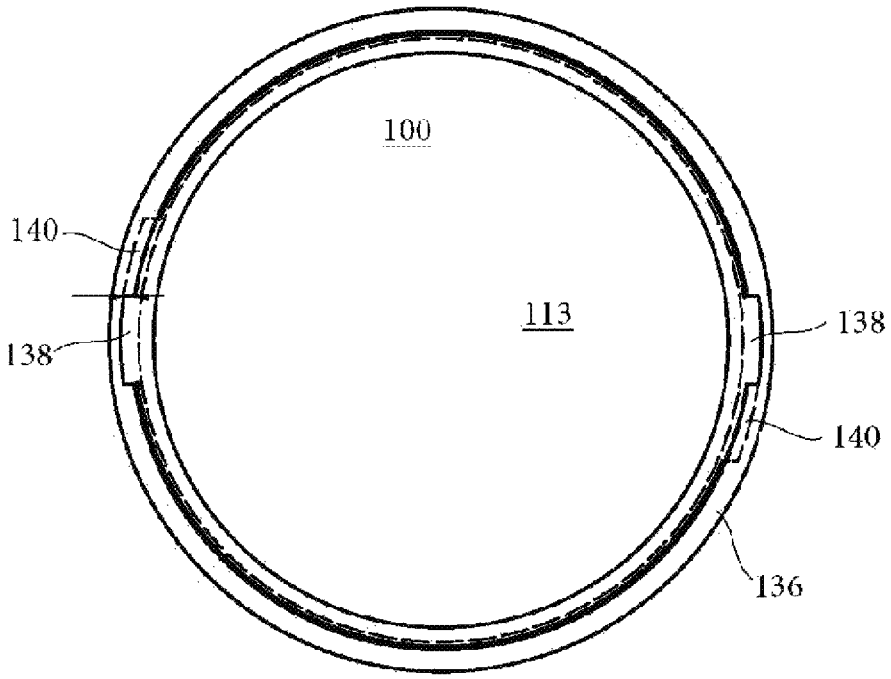
FIG. 4 depicts an inside plan view of the ornament bottom piece.
Figure 5:
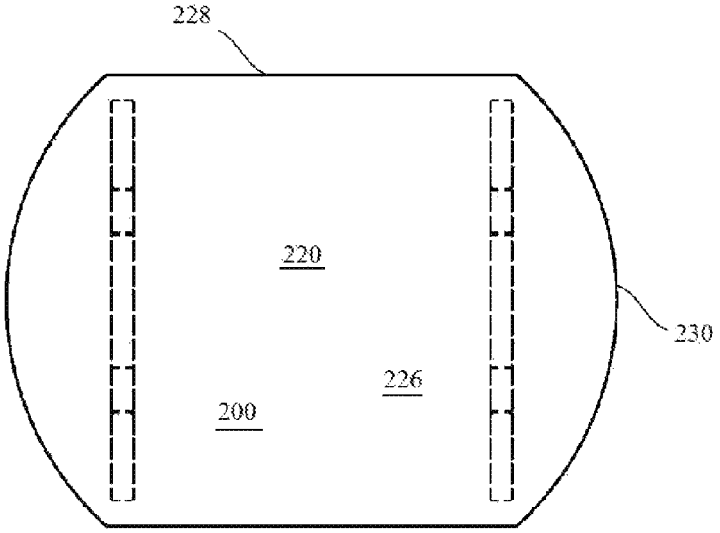
FIG. 5 depicts a plan view of the platform of the recording apparatus.
Figure 19:
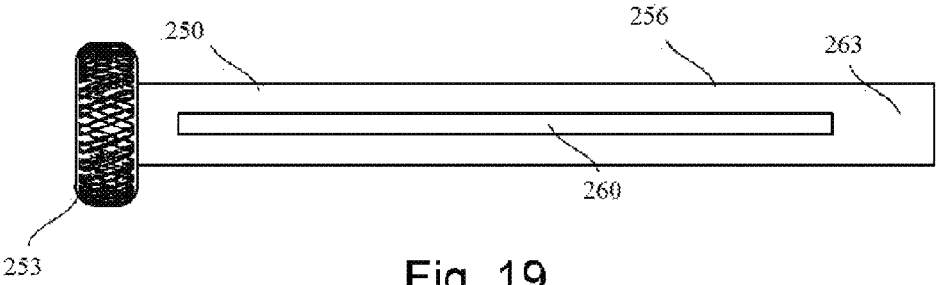
FIG. 19 depicts an elevation view of the scroll post.
Figure 6:
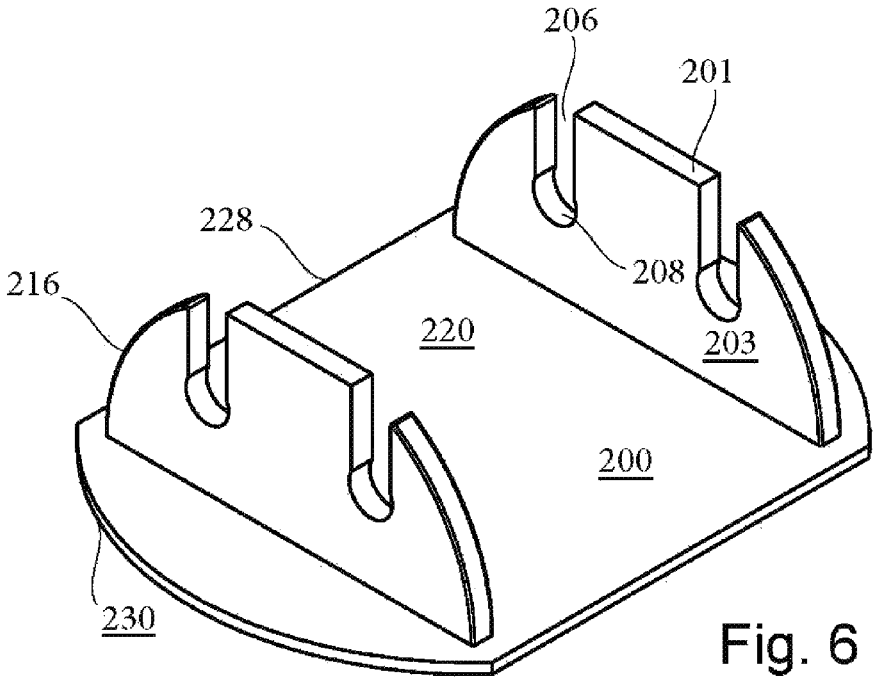
FIG. 6 depicts a perspective view of the scroll attaching side of the recording apparatus.
Figure 7:
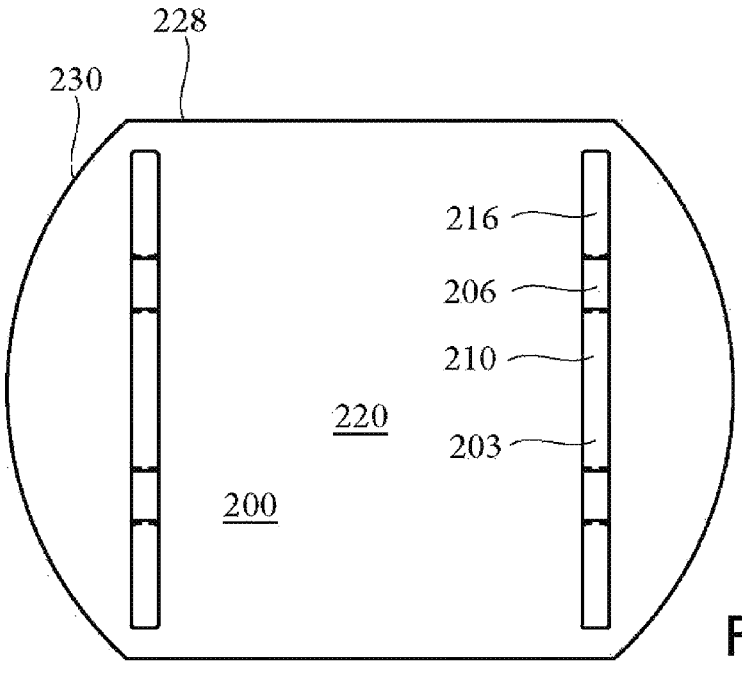
FIG. 7 depicts a plan view of the scroll attaching side of the recording apparatus.
Figure 8:
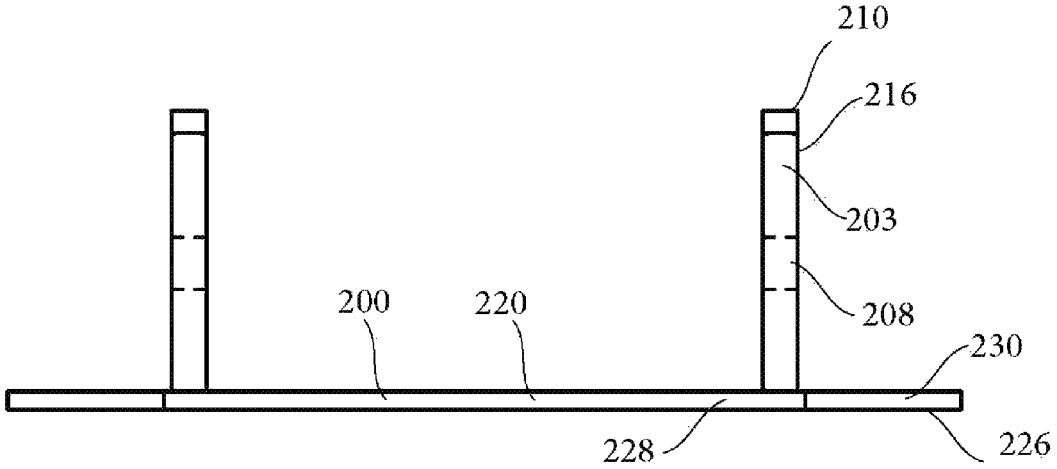
FIG. 8 depicts an elevation view of the recording apparatus.
Figure 9:
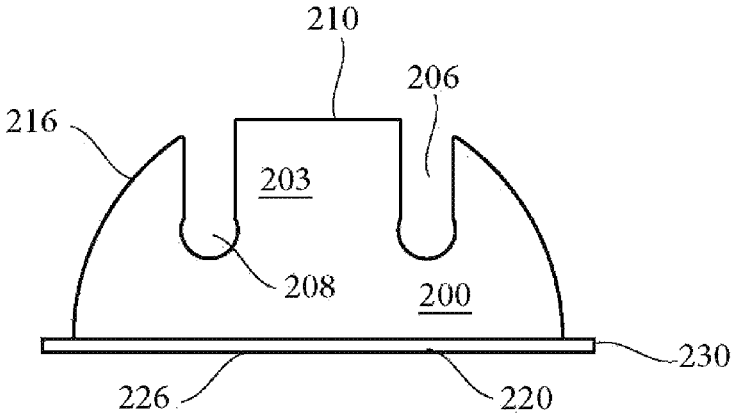
FIG. 9 depicts a side elevation view of the recording apparatus rotated 90°.

Ornament 50 may have Ornament bottom 100, a Recording apparatus 200, and an Ornament top 300.

Referring now to FIGS. 1-4, Ornament bottom 100 may have an Ornament bottom rim 110, an Ornament bottom exterior surface 106, an Ornament bottom interior surface 113, Ornament bottom ledge 120, Ornament bottom ledge resting surface 123, Ornament bottom cavity 130, Ornament bottom sealing surface 136, Ornament tab entry slot 138 and Ornament tab locked position slot 140.

Referring now to FIGS. 5-9 of the drawings, Recording apparatus 200 may have two Scroll support pieces 203 and a Platform 220. Platform 220 may have a Platform writing surface 226, platform straight edges 228, and Platform rounded edges 230. Scroll support pieces 203 may have Open slots 206, Post holes 208, Standing edges 210, and Scroll support rounded edges 216.

Figure 10:
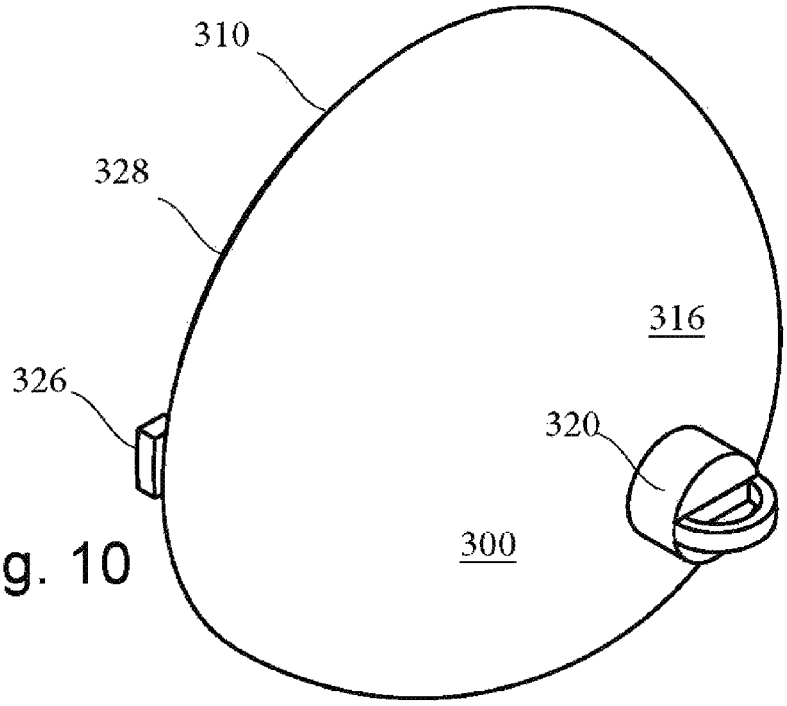
FIG. 10 depicts a perspective view of the ornament top.
Figure 11:
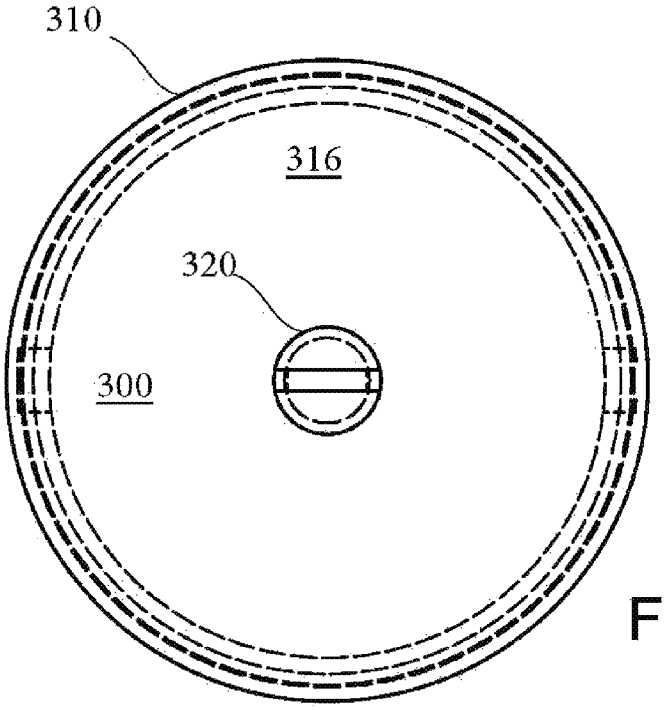
FIG. 11 depicts a plan view of the ornament top from the top.
Figure 12:
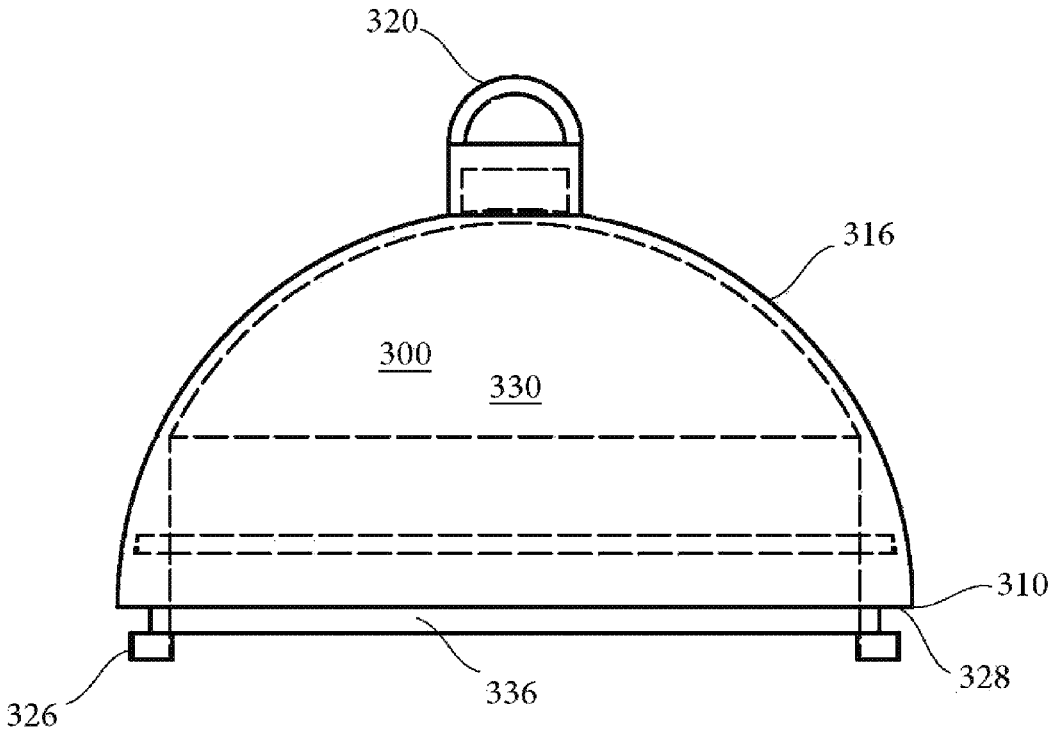
FIG. 12 depicts a side elevation view of the ornament top.

Referring now to FIGS. 10-12 of the drawings, Ornament top 300 may have an Ornament top rim 310, an Ornament top exterior surface 316, an Ornament hook attachment portion 320, a Locking tab 326, an Ornament top sealing surface 328, an Ornament top cavity 330, and an Ornament attachment guide 336.

Figure 15:
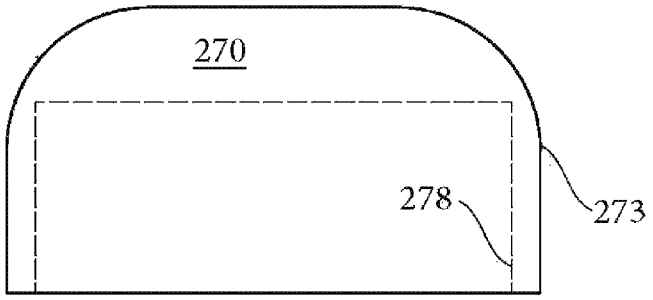
FIG. 15 depicts a side elevation view of the scroll cap.
Figure 13:
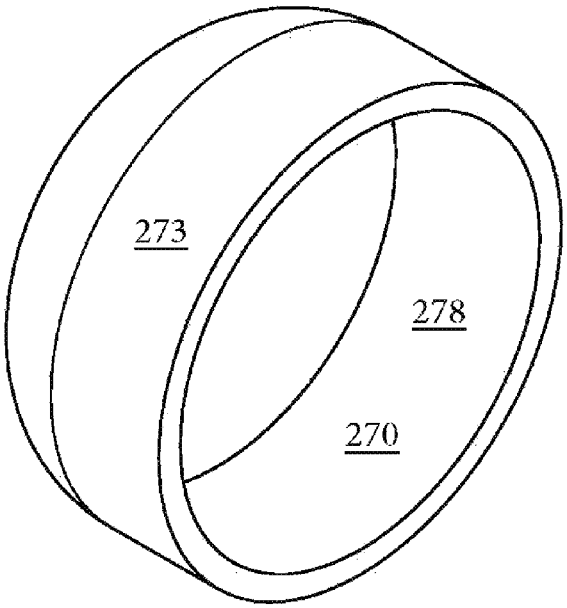
FIG. 13 depicts a perspective view of the scroll cap.
Figure 14:
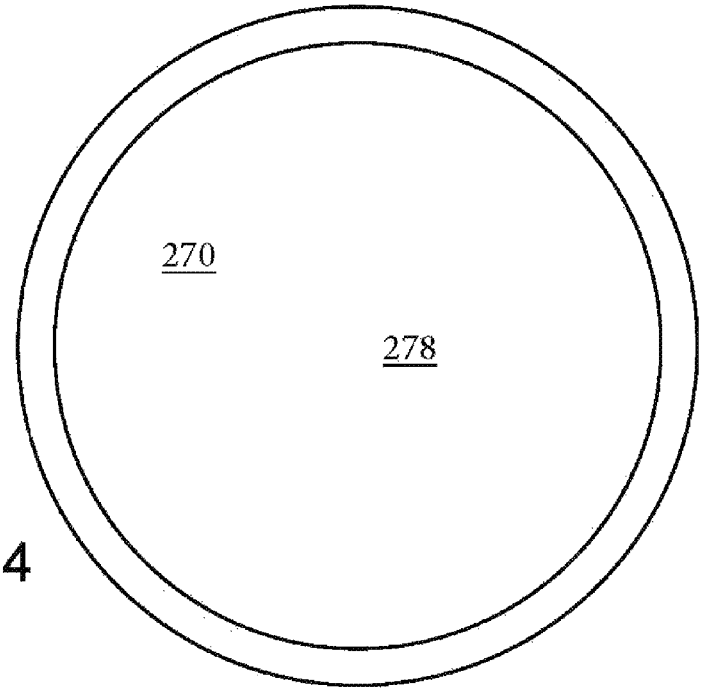
FIG. 14 depicts an underside plan view of the scroll cap.
Figure 16:
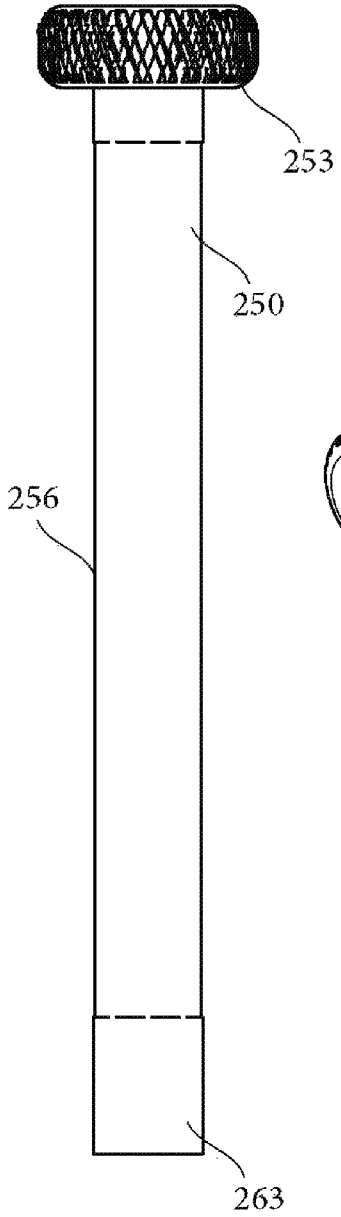
FIG. 16 depicts a side elevation view of the scroll post.
Figure 17:
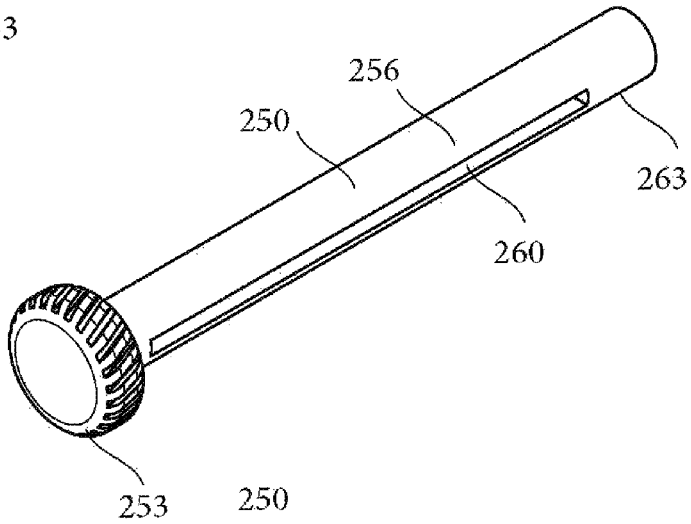
FIG. 17 depicts a perspective view of the scroll post.
Figure 18:
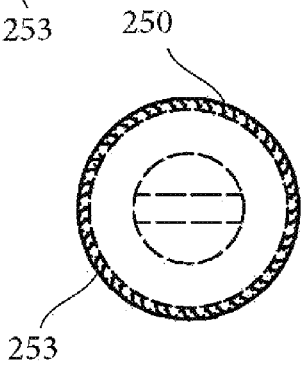
FIG. 18 depicts a top view of the scroll post.

Referring now to FIGS. 13-15 of the drawings, Scroll cap 270 may have a Scroll cap exterior surface 273 and a Scroll cap interior surface 278.

Referring now to FIGS. 16-19 of the drawings, Scroll post 250 may have a Scroll post head 253, a Scroll post shaft 256, a Paper attachment slot 260, and a Scroll post cap end 263.

Figure 20:
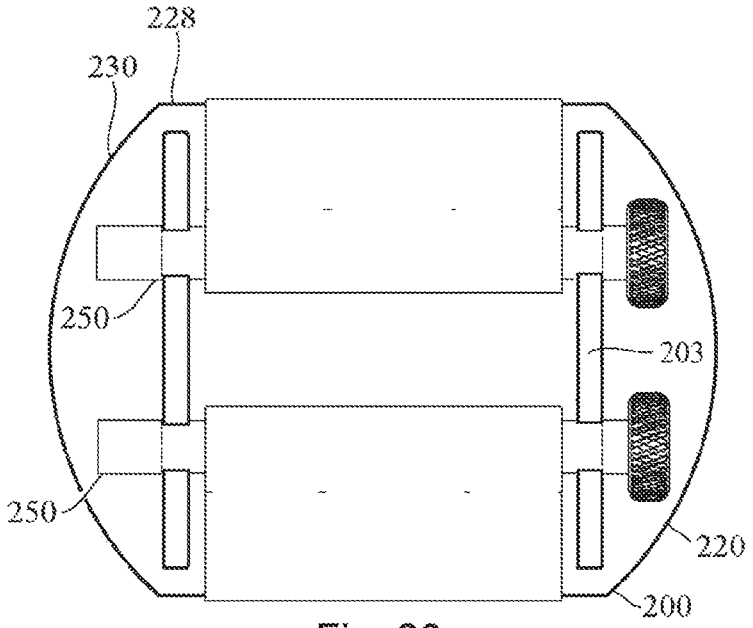
FIG. 20 depicts a plan view of the scroll attaching side of the recording apparatus with paper.
Figure 21:
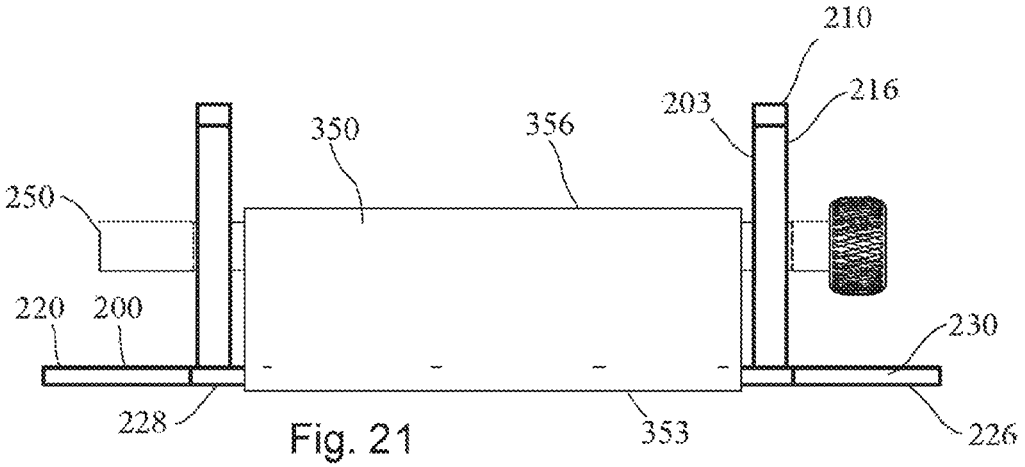
FIG. 21 depicts an elevation view of the recording apparatus with paper.

Referring now to FIGS. 20 and 21 of the drawings, Recording apparatus 200, Scroll support pieces 203, Platform 220, Platform writing surface 226, Platform straight edges 228, Platform rounded edges 230, Standing edges 210, Scroll support rounded edges 216 and Scroll post 250 may be configured and cooperate as previously described. Paper 350 may stretch from Scroll post 250 to the other Scroll post 250 over Platform writing surface 226 such that there is Paper in the display position 353 and Paper not in the display position 356.

Paper may be wrapped around Recording apparatus 200 and over Platform writing surface 226 such that the paper creates a flat and suitable writing surface for recording information such as a New Year's resolution. In such a configuration, either of Scroll post 250 may be rotated such that the paper is pulled across Platform writing surface 226 revealing either new blank paper or paper with previously recorded information depending on which of Scroll post 250 is rotated. Recording apparatus 200 may rest stably on a flat surface, such as a table, such that writing may be accomplished on paper because Standing edges 210 are flat and oriented to enable writing on the paper that is drawn over Platform writing surface 226. Also, Standing edges 210, Platform 220, Scroll support rounded edges 216, Platform writing surface 226, platform straight edges 228, and Platform rounded edges 230 are all configured such that they fit into Ornament bottom cavity 130. Further, Platform 220 may be stably supported within Ornament bottom cavity 130 such that writing on the paper of Recording apparatus 200 may be accomplished with Recording apparatus 200 stably supported by Ornament bottom 100. Such stable support is accomplished by Platform rounded edges 230 resting on Ornament bottom ledge resting surface 123. This stable support of Recording apparatus 200 within Ornament bottom 100 allows a user of the ornament to hold Ornament bottom 100 with Recording apparatus 200 inside of Ornament bottom 100 such that Recording apparatus 200 is stably supported and Recording apparatus 200 experiences very little movement relative to Ornament bottom 100. The total translational movement of Recording apparatus 200 relative to Ornament bottom 100 in such a configuration may be less than 0.2 inches. When Recording apparatus 200 is in Ornament bottom 100, Ornament bottom 100 may be held by the user in one hand while the user writes on the paper with the other hand.

Recording apparatus 200 may be assembled by sliding two Scroll posts 250 through the four Post holes 208 such that they run parallel to platform straight edges 228. Next, a Scroll cap 270 may be fixed on the end of each of Scroll posts 250 such that they are substantially fixed within Post holes 208. Then a long sheet of paper sized to fit within Paper attachment slot 260 may be run through Paper attachment slot 260 and may be attached to Scroll post 250 by either rolling and friction fit or by tape. Paper may then be scrolled onto Scroll post 250 thereby creating a roll of paper. The opposite end of the paper may then be run over Platform 220 and Platform writing surface 226. Paper would then be attached to the opposite Scroll post 250 in a manner similar to the attachment to the other Scroll post 250.

In an alternate embodiment, Scroll post 250 and Scroll cap 270 may be molded as a single piece such that the assembly of Recording apparatus 200 is in part accomplished by sliding two Scroll posts 250 with integral Scroll caps 270 through Open slots 206 and into Post holes 208. In another embodiment, a Scroll post head 253 could be located at either end or both ends of Scroll post 250. In still further embodiments, other types of handles may be employed as alternates to Scroll post head 253 including various knobs and handle components.

Ornament bottom 100 may be attached to Ornament top 300 by a twist lock action that cooperatively engages Locking tab 326 within Ornament tab entry slot 138 and ultimately within Ornament tab locked position slot 140 such that Ornament bottom rim 110 becomes flush with Ornament top rim 310. Recording apparatus 200 is located within Ornament bottom 100 such that when Ornament 50 is closed both Locking tab 326 and Platform 220 are in contact with Ornament bottom ledge resting surface 123. This configuration is made possible by the fact that Platform rounded edges 230 do not completely surround Platform 220. Accordingly, when Recording apparatus 200 is within Ornament 50 and Ornament 50 is in the closed position, Locking tabs 326 would be located adjacent to platform straight edges 228. Because of the twist lock configuration of Ornament 50, Ornament 50 may securely hold the weight of its contents including both Recording apparatus 200 and an optional additional item which may be located within Ornament top cavity 330.

Additional Examples

Ornaments described herein may, for example comprise an ornament body; a quantity of paper within the ornament body and a support configured to hold the first section of the quantity of paper wherein the support and the quantity of paper may be configured such that the first section can travel and transition through a display position, wherein the ornament is sized and configured to hang from a tree and wherein the quantity of paper is configured to transition through the display position by way of a scrolling action. The ornament body may for example take the form of Ornament bottom 100 and Ornament top 300; however, many alternate configurations such as cubes, or various holiday shapes may be employed. The ornament body may take a number of forms that either hold or contain the recording components described herein. Recording apparatus 200 as depicted in FIGS. 5-9 is an example of a support usable with the paper as part of the ornament. Other such supports may have writing surfaces or other features that facilitate the recording of information on paper. Configurations of supports resembling a table platform or other similar form may be used in various configurations and embodiments. As indicated above, various portions of paper within the ornament may be called out as sections. Such sections may be written upon by a user in a way that allows a user of the ornament to move between sections such as a first section and a second section in a manner that allows the display of the first section while the second section is hidden, then allows for movement of the paper in a way that hides the first section and brings the second section into view. Display positions may include areas of the ornament that are suited for viewing of the paper. Platform 220 is an example of a display position, but many alternate configurations may be employed as the paper could be oriented in a variety of different ways and the display position need not necessarily be out of view when the ornament is closed. For example, the ornament may not completely conceal the paper when the ornament is hung from a tree as an ornament such as hanging from a Christmas tree. Paper may be moved in a scrolling action for example by turning a Scroll post head 253 to move the paper along Platform 220. In a related example, the quantity of paper may be at least 10 square inches of paper. In another related example, the paper may have a width of at least one inch and in certain cases may have a width of at least 1.5 inches. In a related example, the ornament may have a paper retention area sized and configured to hold a major fraction of the quantity of paper wherein the major fraction is not in the display position. The paper retention area may for example may be the area beneath Recording apparatus 200 where the scrolls may be placed. Alternatively, any number of clips, pins, compartments or other means of retaining paper may be used. The paper retention area in many cases would be out of view, but need not be out of view. The paper retention area may serve to hold portions of the paper that are not currently the focus of attention or are not currently on display. As used herein, the major fraction of paper designates a majority of the paper and in many cases the major fraction of paper is several times the amount of paper on display. In a related example, the paper retention area may be configured to hold all of the quantity of paper over a period of time. In the embodiment depicted in Example 1, the paper moves back and forth by scrolling action such that over a period of time in which the paper is moved in a significant way, the entire quantity of paper may be at one time or another located in the paper retention area. In a related example, the support may have a display platform, the support may be removable from the ornament body and the display platform may be secured within an enclosure formed by the ornament body. The enclosure may, for example, be greater than two inches across. As a further example, the enclosure may be less than three inches across. The display platform may, for example, be Platform 220 as described in Example 1. Alternatively, the platform could be formed in a number of shapes including square and rectangle and could take on any number of orientations including a vertical orientation and various orientations between horizontal and vertical.

Ornaments described herein may, for example comprise an ornament body; a quantity of paper wherein the quantity of paper is sufficient to comprise a series of independent message sections, wherein the series of independent message sections includes a first portion in a display position and wherein the series of independent message sections includes a second portion that is not in the display position; and a support configured to hold the first portion; wherein the second portion is several times the size of the first portion, wherein the ornament body forms a releaseably closable enclosure, wherein the ornament body is configured to close securely and wherein the quantity of paper is within the releaseably closable enclosure. The series of independent message sections may be sections of the paper that do not overlap and those sections may move into and out of the display area. In a related example, the second portion may be inaccessible from outside of the ornament body when the releaseably closable enclosure is closed and wherein the second portion is protected from light when the releaseably closable enclosure is closed. In a further related example, the quantity of paper may be at least 10 square inches of paper. In a still further related example, the quantity of paper may be configured to transition through the display position by way of a scrolling action.

Ornaments described herein may, for example comprise an ornament body; a quantity of paper wherein the quantity of paper is sufficient to comprise a series of independent message sections, wherein the series of independent message sections includes a first portion in a display position and wherein the series of independent message sections includes a second portion that is not in the display position; and a support configured to hold the first portion wherein the support comprises a display platform, wherein the display position is on the display platform and wherein the display platform comprises a hard flat surface suitable for writing on the quantity of paper. The hard flat surface may, for example be the top of Platform 220. The platform may, for example, be greater than two inches wide. In certain embodiments, the hard flat surface has a top surface area greater than three square inches. In a related example, the support may be removable from the ornament body, wherein the ornament body forms a releaseably closable enclosure and wherein the display platform can be secured within the releaseably closable enclosure. The locking mechanism including Locking tabs 326 is an example of a releaseably closable enclosure and many other mechanical fasteners and locking mechanisms may be used for that purpose. In a related example, a paper retention area may be sized and configured to hold a major fraction of the quantity of paper wherein the major fraction is not in the display position; wherein the quantity of paper is at least 10 square inches of paper; wherein the paper retention area is configured to hold all of the quantity of paper over a period of time; wherein the second portion is inaccessible from outside of the ornament body when the releaseably closable enclosure is closed; wherein the second portion is protected from light when the releaseably closable enclosure is closed and wherein the quantity of paper is configured to transition through the display position by way of a scrolling action. In a related example, the support may be separable from the ornament body and the support may be configured to rest stably on a flat level surface in a manner suitable for writing on the quantity of paper. In a related example, the ornament may have a paper retention area sized and configured to hold a major fraction of the quantity of paper wherein the major fraction is not on the display platform. In a further related example, the paper retention area may be configured to hold all of the quantity of paper over a period of time. In a related example, a width of the ornament body may be less than 5 inches and the height of the ornament body may be less than 8 inches. In a still further related example, the quantity of paper may be configured to transition between the series of independent message sections by way of a scrolling action.

The above-described embodiments have a number of independently useful individual features that have particular utility when used in combination with one another including combinations of features from embodiments described separately. There are, of course, other alternate embodiments which are obvious from the foregoing descriptions of the invention, which are intended to be included within the scope of the invention, as defined by the following claims.

What is claimed is:

1. An ornament comprising:

a. an ornament body;

b. a quantity of paper within the ornament body and c. a support configured to hold a first section of the quantity of paper d. wherein the support and the quantity of paper are configured such that the first section can travel and transition through a display position, e. wherein the ornament is sized and configured to hang from a tree;

f. wherein the quantity of paper is configured to transition through the display position by way of a scrolling action;

g. wherein the support comprises a display platform, h. wherein the support is removable from the ornament body and i. wherein the display platform can be secured within an enclosure formed by the ornament body.

2. The ornament of claim 1 wherein the quantity of paper is at least 10 square inches of paper.

3. The ornament of claim 1 further comprising a paper retention area sized and configured to hold a major fraction of the quantity of paper wherein the major fraction is not in the display position.

4. The ornament of claim 3 wherein the paper retention area is configured to hold all of the quantity of paper over a period of time.

5. An ornament comprising:

a. an ornament body;

b. a quantity of paper c. wherein the quantity of paper is sufficient to comprise a series of independent message sections, d. wherein the series of independent message sections includes a first portion in a display position and e. wherein the series of independent message sections includes a second portion that is not in the display position; and f. a support configured to hold the first portion g. wherein the support comprises a display platform, h. wherein the display position is on the display platform and i. wherein the display platform comprises a hard flat surface suitable for writing on the quantity of paper.

6. The ornament of claim 5 a. wherein the support is removable from the ornament body, b. wherein the ornament body forms a releaseably closable enclosure and c. wherein the display platform can be secured within the releaseably closable enclosure.

7. The ornament of claim 5 wherein a width of the ornament body is less than 5 inches and wherein the height of the ornament body is less than 8 inches.

8. The ornament of claim 5 wherein the quantity of paper is configured to transition between the series of independent message sections by way of a scrolling action.

* * * * *